US008734089B2

(12) United States Patent
Gilman

(10) Patent No.: US 8,734,089 B2
(45) Date of Patent: May 27, 2014

(54) DAMPER SEAL AND VANE ASSEMBLY FOR A GAS TURBINE ENGINE

(75) Inventor: Justin Gilman, Diamondhead, MS (US)

(73) Assignee: Rolls-Royce Corporation, Indianapolis, IN (US)

( * ) Notice: Subject to any disclaimer, the term of this patent is extended or adjusted under 35 U.S.C. 154(b) by 653 days.

(21) Appl. No.: 12/976,110

(22) Filed: Dec. 22, 2010

(65) Prior Publication Data

US 2012/0099969 A1 Apr. 26, 2012

Related U.S. Application Data

(60) Provisional application No. 61/290,601, filed on Dec. 29, 2009.

(51) Int. Cl.
*F04D 29/08* (2006.01)

(52) U.S. Cl.
USPC ..... 415/119; 415/191; 415/208.2

(58) Field of Classification Search
USPC ..... 415/119, 199.5, 191, 208.2; 277/644, 277/647
See application file for complete search history.

(56) References Cited

U.S. PATENT DOCUMENTS 4,285,633 A 8/1981 Jones
4,314,792 A 2/1982 Chaplin
4,537,024 A 8/1985 Grosjean
4,655,682 A 4/1987 Kunz et al.
5,215,432 A 6/1993 Pickering et al.
5,228,835 A 7/1993 Chlus
5,738,490 A 4/1998 Pizzi
5,762,472 A 6/1998 Pizzi et al.
5,785,499 A 7/1998 Houston et al.
5,803,710 A 9/1998 Dietrich et al.
5,827,047 A 10/1998 Gonsor et al.
5,924,699 A 7/1999 Airey et al.
5,988,975 A 11/1999 Pizzi
6,076,835 A 6/2000 Ress et al.
6,273,683 B1 8/2001 Zagar et al.
6,315,519 B1 11/2001 Bagepalli et al.
6,332,617 B1 12/2001 Leveaux et al.
6,375,428 B1 4/2002 Stangeland et al.
6,398,499 B1 6/2002 Simonetti et al.
6,659,725 B2 12/2003 Yeo et al.
6,733,234 B2 5/2004 Paprotna et al.

OTHER PUBLICATIONS

International Search Report and Written Opinion, PCT/US2010/062379, Rolls-Royce Corporation, Oct. 11, 2011.

*Primary Examiner* — Edward Look
*Assistant Examiner* — Maxime Adjagbe
(74) *Attorney, Agent, or Firm* — Krieg DeVault LLP

(57) ABSTRACT

One embodiment of the present invention is a vane assembly for a gas turbine engine. Another embodiment of the present invention is a damper seal that may be employed in conjunction with a vane assembly of a gas turbine engine. Other embodiments include apparatuses, systems, devices, hardware, methods and combinations for vane assemblies and the sealing and damping thereof. Further embodiments, forms, features, aspects, benefits and advantages of the present application shall become apparent from the description and figures provided herewith.

20 Claims, 4 Drawing Sheets

DAMPER SEAL AND VANE ASSEMBLY FOR A GAS TURBINE ENGINE

CROSS REFERENCE TO RELATED APPLICATIONS

The present application claims the benefit of U.S. Provisional Patent Application 61/290,601, filed Dec. 29, 2009, and is incorporated herein by reference.

GOVERNMENT RIGHTS

The present application was made with United States government support under contract number N00019-04-C-0093 awarded by the United States Navy. The United States government may have certain rights in the present application.

FIELD OF THE INVENTION

The present invention relates to a gas turbine engine, and more particularly, to a damper seal for a vane assembly of a gas turbine engine.

BACKGROUND

Systems for compressing air and discharging the air to a combustor of a gas turbine engine remain an area of interest. Some existing systems have various shortcomings, drawbacks and disadvantages relative to certain applications. Accordingly, there remains a need for further contributions in this area of technology.

SUMMARY

One embodiment of the present invention is a vane assembly for a gas turbine engine. Another embodiment of the present invention is a damper seal that may be employed in conjunction with a vane assembly of a gas turbine engine. Other embodiments include apparatuses, systems, devices, hardware, methods and combinations for vane assemblies and the sealing and damping thereof. Further embodiments, forms, features, aspects, benefits and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
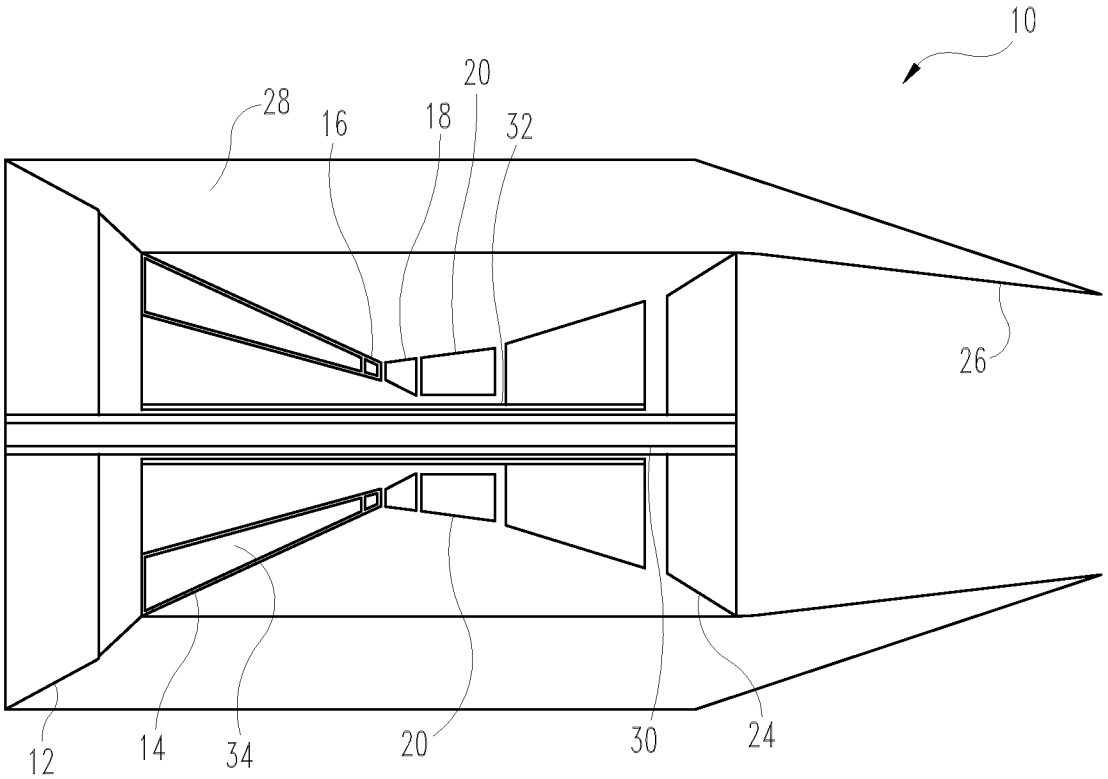
FIG. 1 is a schematic depiction of a gas turbine engine in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment (s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring now to the drawings, and in particular, FIG. 1, a non-limiting example of a gas turbine engine 10 in accordance with an embodiment of the present invention is schematically depicted. Gas turbine engine 10 is an axial flow turbofan engine, e.g., an aircraft propulsion power plant. In one form, gas turbine engine 10 is a turbofan engine. In other embodiments, gas turbine engine 10 may take other forms, including turbojet engines, turboprop engines, and turboshaft engines having axial, centrifugal and/or axi-centrifugal compressors and/or turbines.

In the illustrated embodiment, gas turbine engine 10 includes a fan 12, a compressor 14 with outlet guide vane (OGV) 16, a diffuser 18, a combustor 20, a high pressure (HP) turbine 22, a low pressure (LP) turbine 24, an exhaust nozzle 26 and a bypass duct 28. Diffuser 18 and combustor 20 are fluidly disposed between OGV 16 of compressor 14 and HP turbine 22. LP turbine 24 is drivingly coupled to fan 12 via an LP shaft 30. HP turbine 22 is drivingly coupled to compressor 14 via an HP shaft 32. In one form, gas turbine engine 10 is a two-spool engine. In other embodiments, engine 10 may have any number of spools, e.g., may be a three-spool engine or a single spool engine.

Compressor 14 includes a plurality of blades and vanes 34 for compressing air. During the operation of gas turbine engine 10, air is drawn into the inlet of fan 12 and pressurized by fan 12. Some of the air pressurized by fan 12 is directed into compressor 14 and the balance is directed into bypass duct 28. Bypass duct 28 directs the pressurized air to exhaust nozzle 26, which provides a component of the thrust output by gas turbine engine 10. Compressor 14 receives the pressurized air from fan 12, which is compressed by blades and vanes 34.

The pressurized air discharged from compressor 14 is then directed downstream by OGV 16 to diffuser 18, which diffuses the airflow, reducing its velocity and increasing its static pressure. The diffused airflow is then directed into combustor 20. Fuel is mixed with the air in combustor 20, which is then combusted in a combustion liner (not shown). The hot gases exiting combustor 20 are directed into HP turbine 22, which extracts energy from the hot gases in the form of mechanical shaft power to drive compressor 14 via HP shaft 32. The hot gases exiting HP turbine 22 are directed into LP turbine 24, which extracts energy in the form of mechanical shaft power to drive fan 12 via LP shaft 30. The hot gases exiting LP turbine 24 are directed into nozzle 26, and provide a component of the thrust output by gas turbine engine 10.

Figure 2:
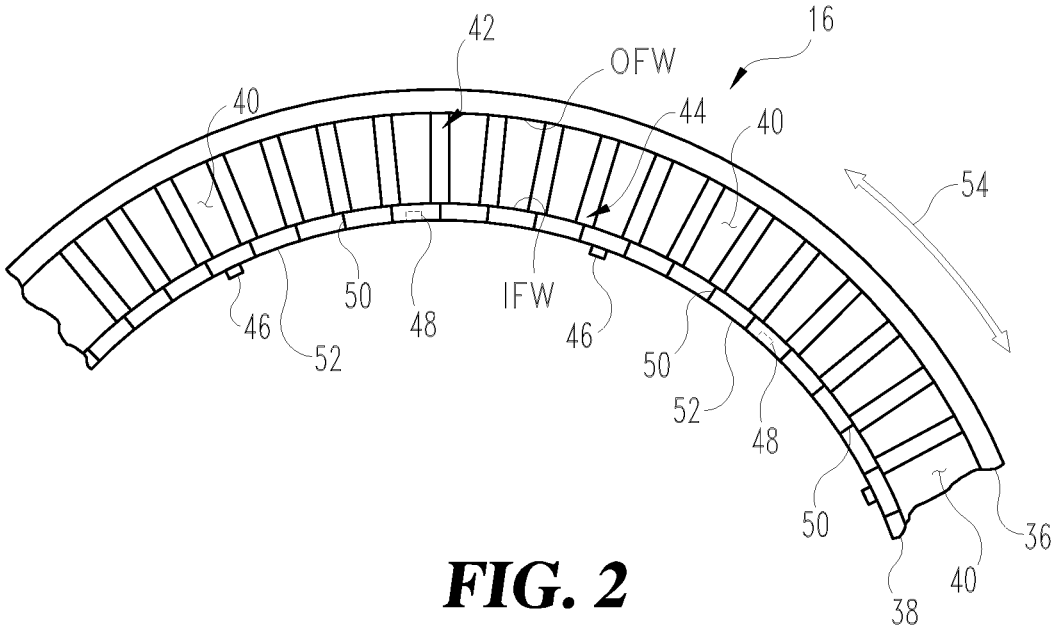
FIG. 2 is a partial view of an outlet guide vane (OGV) employed in accordance with an embodiment of the present invention.

Referring now to FIG. 2, OGV 16 is further described. In the depiction of FIG. 2, diffuser 18, located just downstream from OGV 16, is not shown for purposes of clarity of illustration.

OGV 16 is a 360° compressor vane assembly having an outer band 36, an inner band 38 and plurality of vanes 40. Outer band 36 defines an outer flowpath wall OFW of OGV 16. Inner band 38 defines an inner flowpath wall IFW of OGV 16. Vanes 40 are airfoils, and are spaced apart from each other circumferentially. Vanes 40 extend in the radial direction between outer band 36 and inner band 38. Each vane 40 has a tip end 42 and a root end 44.

OGV 16 is attached to a static structure (not shown) of gas turbine engine 10 at outer band 36, e.g., via a bolted interface. In one form, OGV 16 is a unitary 360° casting. In other embodiments, OGV 16 may be formed from a plurality of circumferential vane segments that are assembled together, e.g., at installation into gas turbine engine 10.

Inner band 38 includes a plurality of bosses 46 and threaded bolt holes 48. In one form, bosses 46 and threaded bolt holes 48 are circumferentially and alternatingly spaced apart around the inner periphery of inner band 38. In other embodiments, other arrangements and/or spacing schemes may be employed. Inner band 38 is split between each vane 40 into segments. In one form, each segment extends from (includes) a single airfoil, i.e., vane 40. In other embodiments, each segment may include more than one airfoil. In a particular form, inner band 38 is subdivided at partitions 50 into a plurality of circumferential inner band segments 52, which may help reduce thermally induced stresses in OGV 16. Partitions 50 are equally spaced around the circumference of inner band 38 in circumferential direction 54. Each vane 40 is coupled to outer band 36 at tip end 42, and is coupled to a respective inner band segment 52 at root end 44.

In one form, partitions 50 are located on both sides of each vane 40, and hence each inner band segment 52 corresponds to a single vane 40. In other embodiments, each inner band segment 52 may correspond with two or more vanes 40, in which case a corresponding number of two or more vanes 40 are positioned between each pair of partitions 50. In one form, each partition 50 is formed by electrical discharge machining (EDM) of inner band 38, in particular using a wire EDM machine. In other embodiments, other methods of cutting or machining may be employed to form each partition 50, for example, laser cutting, waterjet cutting and/or abrasivejet cutting.

During the operation of gas turbine engine 10, pressurized air passes through vanes 40 at a high rate of speed, which may induce a vibratory response into OGV 16. For example, each inner band segment 52 and the corresponding vane 40 may behave as a cantilevered spring-mass system which may respond to excitation provided by the pressurized air being discharged through OGV 16 into diffuser 18. In addition, air exiting OGV 16 may leak between the aft end of OGV 16 and diffuser 18, thereby resulting in parasitic losses that may adversely affect the performance and efficiency of gas turbine engine 10.

Figure 3:
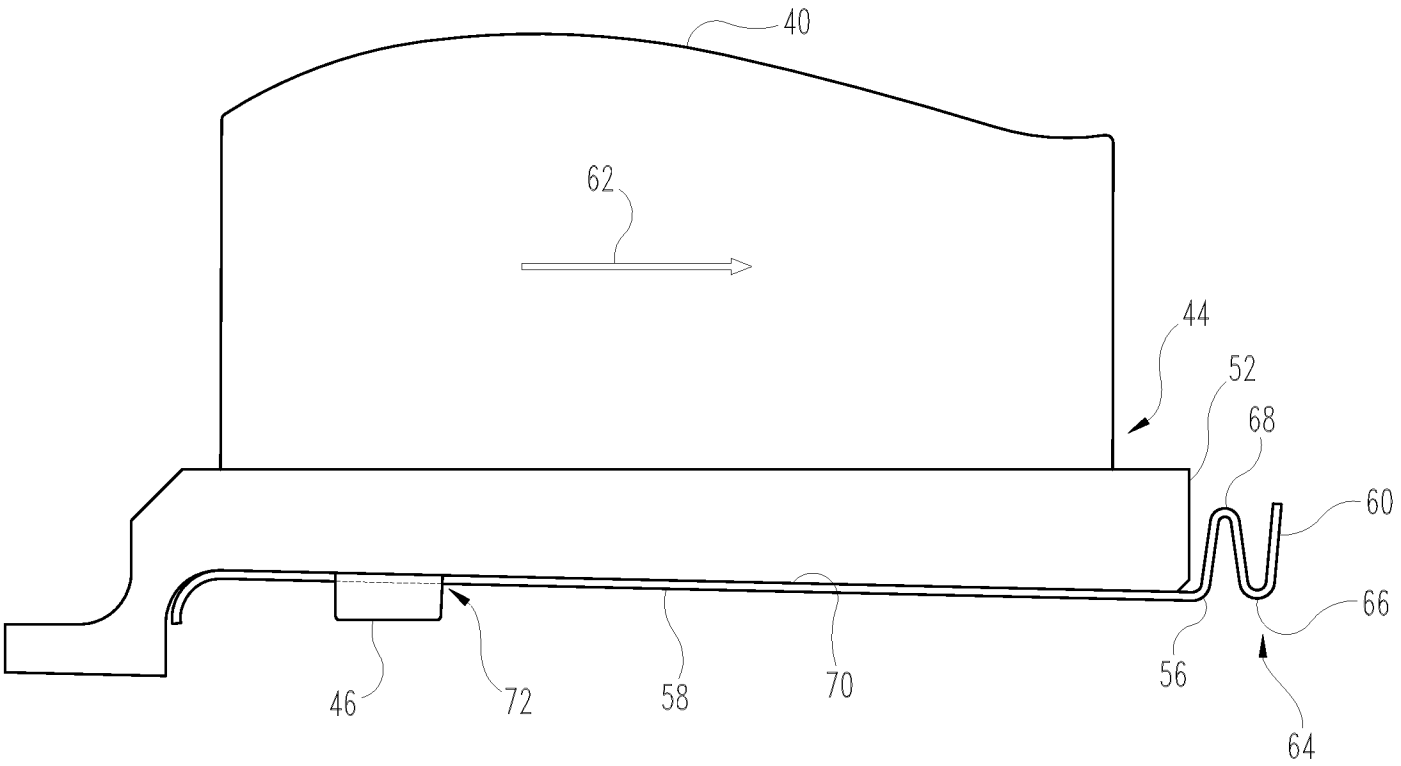
FIG. 3 is a sectional view of the OGV of FIG. 2 with a damper seal in accordance with an embodiment of the present invention.

Referring now to FIG. 3, a non-limiting example of a damper seal 56 in accordance with an embodiment of the present invention is depicted. In one form, damper seal 56 is configured for use in an inner band of a compressor vane assembly. In other embodiments, damper seal 56 may be configured for use in an outer band of a compressor vane assembly and/or inner and/or outer bands of turbine vane assemblies.

Damper seal 56 includes a friction damper portion 58 and an air seal portion 60. Friction damper portion 58 extends circumferentially along inner band 38 in circumferential direction 54 (see FIG. 2). In one form, friction damper portion 58 is a continuous strip, e.g., a continuous strip formed into a ring. In one form, friction damper portion 58 is a continuous strip formed into a ring, and welded together at its ends. In other embodiments, the ends of the strip may not be welded together. In other embodiments, friction damper portion 58 may be formed by joining together a plurality of individual segments, or may be otherwise formed as a continuous ring. In still other forms, friction damper portion 58 may be discontinuous, e.g., and may include one or more continuous ring portions having damper segments extending therefrom that are distributed circumferentially in circumferential direction 54 along inner band 38.

Friction damper portion 58 is structured to contact each inner band segment 52. Friction damper portion 58 provides friction damping of inner band segments 52 based on the contact, e.g., in the form of friction losses due to sliding contact between inner band segments 52 and friction damper portion 58. In other embodiments, it is alternatively contemplated that friction damper portion 58 contacts only certain inner band segments. Contact between friction damper portion 58 and inner band segments 52 may be maintained, for example, by providing friction damper portion 58 with an outer circumference that is greater than the inner circumference of inner band 38.

In one form, air seal portion 60 extends from friction damper portion 58 in an axial direction 62 that is substantially perpendicular to circumferential direction 54. Axial direction 62 is parallel to the axis of rotation of engine 10 main rotor components, e.g., fan 12, compressor 14, HP turbine 22 and LP turbine 24. In other embodiments, air seal portion extends from friction damper portion in radial and/or axial directions. Air seal portion 60 is structured to seal against diffuser 18, which is spaced apart from OGV 16 downstream in axial direction 62. In one form, air seal portion 60 is structured in the form of a bellows 64 having two convolutions 66 and 68 that extend in axial direction 62, and is compressible in axial direction 62. In other embodiments, air seal portion 60 may take other forms, including bellows having a greater or lesser number of convolutions, and including forms other than bellows.

In one form, air seal portion 60 is integral with friction damper portion 58. Friction damper portion 58 includes a cylindrical surface 70 that extends substantially in axial direction 62, although other surface forms may alternatively be employed. In the present embodiment, air seal portion 60 and friction damper portion 58 are formed from sheet metal, e.g., a common strip of material. It is alternatively contemplated that air seal portion 60 and friction damper portion 58 may be formed separately and subsequently joined together, e.g., via welding, brazing, bolting, or other suitable joining methodology.

In one form, damper seal 56 is attached to inner band 38 using bosses 46 and bolt holes 48. In particular, damper seal 56 includes a plurality of holes 72 corresponding in location to bosses 46 and bolt holes 48. Holes 72 adjacent bosses 46 are slightly smaller in diameter than bosses 46 so as to create an interference fit, e.g., of approximately 0.002 inch, although any suitable interference fit may be employed in other embodiments. Holes 72 adjacent to bolt holes 48 are sized to allow passage therethrough of bolts (not shown) to further secure damper seal 56 to inner band 38. In other embodiments, damper seal 56 may be attached to inner band 38 using other suitable attachment methods, e.g., including other types of mechanical fasteners, clips, etc., and/or brazing and/or welding.

Figure 4:
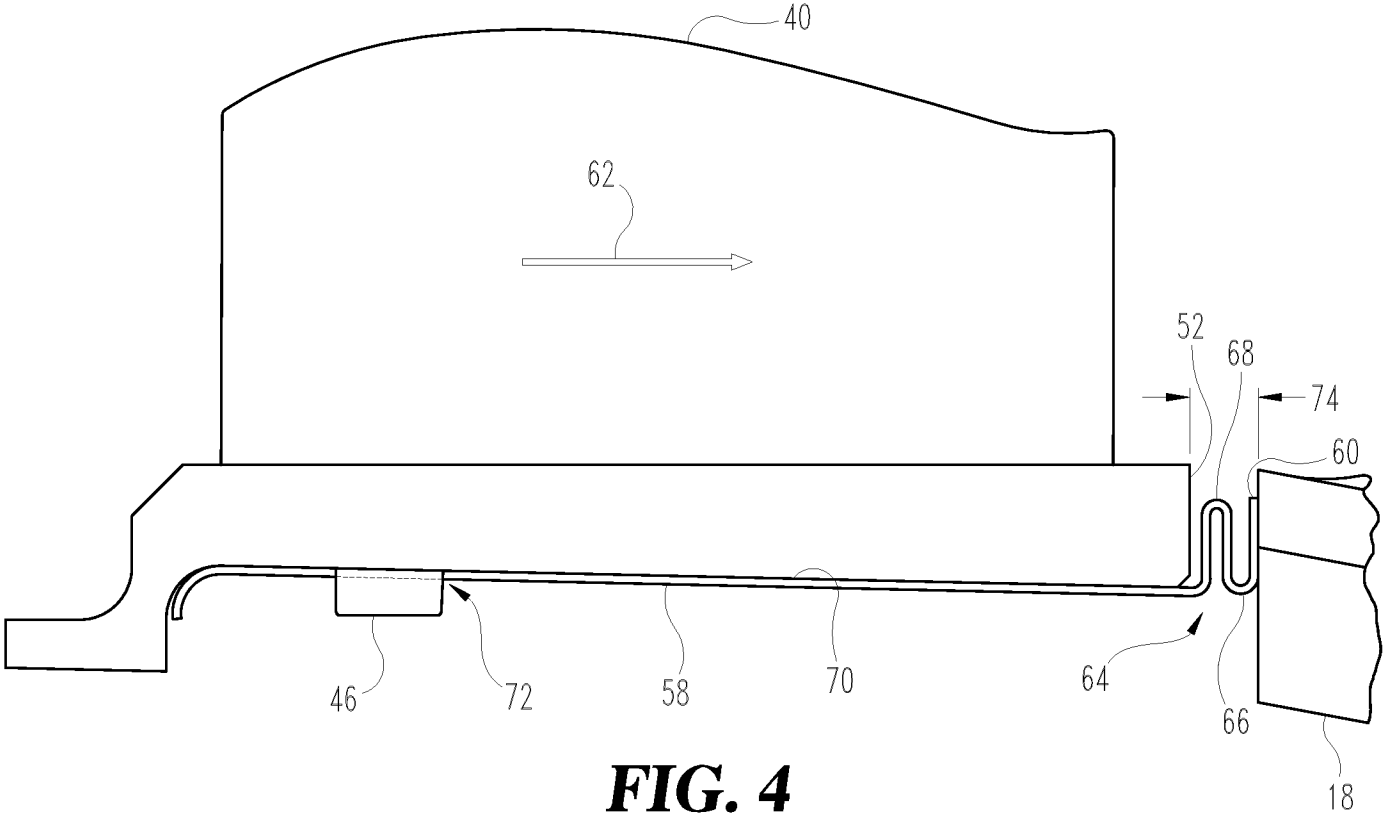
FIG. 4 depicts the OGV and damper seal of FIG. 3 with the damper seal illustrated in an installed condition.

Referring now to FIG. 4, OGV 16 and damper seal 56 are depicted in the installed condition, wherein air seal portion is compressed between OGV 16 and diffuser 18, thus sealing the gap 74 disposed between OGV 16 and diffuser 18.

During the operation of gas turbine engine 10, the excitation of OGV 16, in particular, vanes 40 and inner band segments 52, may result in a reduced vibratory response in OGV 16 due to the friction damping generated by the contact of friction damper portion 58 with inner band segments 52 of inner band 38. In addition, leakage of compressed air between OGV 16 and diffuser 18 may be reduced or eliminated by air seal portion 60, which extends from OGV 16 to diffuser 18. Sealing contact between damper seal 56 and diffuser 18 is maintained by virtue of the compressive stresses in air seal portion 60, in particular, convolutions 66 and 68 of bellows 64.

Embodiments of the present invention include a vane assembly for a gas turbine engine. The vane assembly may include an outer band, an inner band, a plurality of airfoils, and a damper seal. The inner band may be subdivided into a plurality of circumferential segments. The plurality of airfoils may be spaced apart circumferentially and extend between the outer band and the inner band. Each airfoil may have a tip end and a root end, and may be is coupled to the outer band at the tip end, and coupled to a respective segment of the inner band at the root end. The damper seal which may include a friction damper portion extending along the inner band in the circumferential direction. The friction damper may be in contact with at least two of the circumferential segments and may be structured to provide friction damping of at least two circumferential segments based on the contact. The damper seal may also include an air seal portion extending from the friction damper portion in an axial direction substantially perpendicular to the circumferential direction. The air seal may be structured to seal against an engine component that is spaced apart from the vane assembly in the axial direction.

In one refinement of the embodiment the air seal portion is integral with the friction damper portion.

In another refinement of the embodiment the friction damper portion is a continuous strip extending circumferentially along the inner band.

In another refinement of the embodiment the friction damper portion is structured to contact each the circumferential segment.

In another refinement of the embodiment the inner band is split between each airfoil, and each segment extends from a single airfoil.

In another refinement of the embodiment the air seal portion is structured as a bellows.

In another refinement of the embodiment the air seal portion includes at least two convolutions extending in the axial direction.

In another refinement of the embodiment the vane assembly is a compressor vane assembly.

In another refinement of the embodiment the engine component is a diffuser located downstream of a compressor of the gas turbine engine.

In another refinement of the embodiment the outer band defines an outer flowpath wall and the inner band defines an inner flowpath wall.

In another refinement of the embodiment the friction damper portion and the air seal portion are formed from sheet metal.

In another refinement of the embodiment the damper seal is at least one of bolted and pinned to the inner band.

Another embodiment of the present invention may include a damper seal for the vane assembly of a gas turbine engine. The damper seal may include a friction damper portion having a surface structured to contact a segment of a vane assembly to provide friction damping of the segment. The damper seal may also include an air seal portion structured to seal against a gas turbine engine component that is spaced apart from the segment in an axial direction, and the air seal portion may be integral with the friction damper portion.

In one refinement of the embodiment the friction damper and the air seal are formed as a continuous ring.

In another refinement of the embodiment the damper seal is formed from sheet metal.

In another refinement of the embodiment the air seal portion is compressible in the axial direction.

In another refinement of the embodiment the air seal portion is structured as a bellows.

In another refinement of the embodiment the air seal portion includes at least two convolutions extending in the axial direction.

In another refinement of the embodiment the surface extends in the axial direction.

Another embodiment may include a damper seal for a vane assembly of a gas turbine engine. The damper seal may include means for providing friction damping of a plurality of segments of the vane assembly; and means for sealing against a gas turbine engine component that may be spaced apart from the segments in an axial direction, wherein and the means for sealing is integral with the means for providing friction damping.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A vane assembly for a gas turbine engine, comprising:

an outer band;

an inner band, wherein said inner band is subdivided into a plurality of circumferential segments;

a plurality of airfoils spaced apart circumferentially and extending between said outer band and said inner band, wherein each airfoil has a tip end and a root end; and wherein each airfoil is coupled to said outer band at said tip end and coupled to a respective segment of said inner band at said root end; and a damper seal, including:

a friction damper portion extending along said inner band in a circumferential direction, wherein said friction damper portion is in contact with at least two circumferential segments of said plurality of circumferential segments and is structured to provide friction damping of said at least two circumferential segments based on said contact; and an integral air seal portion extending from said friction damper portion and having a compressible end face seal structured to extend outward of and away from said at least two circumferential segments in an axial direction substantially perpendicular to the circumferential direction toward an engine component that is spaced apart from said vane assembly in the axial direction, said air seal portion being structured as a face seal to seal against an axial face of the engine component that is spaced apart from said vane assembly in the axial direction.

2. The vane assembly of claim 1, wherein said air seal portion is integral with said friction damper portion.

3. The vane assembly of claim 1, wherein said friction damper portion is a continuous strip extending circumferentially along said inner band.

4. The vane assembly of claim 3, wherein said friction damper portion is structured to contact each circumferential segment of said plurality of circumferential segments.

5. The vane assembly of claim 4, wherein said inner band is split between each airfoil, and wherein each segment extends from a single airfoil.

6. The vane assembly of claim 3, wherein said air seal portion is structured as a bellows.

7. The vane assembly of claim 6, wherein said air seal portion includes at least two convolutions extending in the axial direction.

8. The vane assembly of claim 1, wherein said vane assembly is a compressor vane assembly.

9. The vane assembly of claim 8, wherein said engine component is a diffuser located downstream of a compressor of the gas turbine engine.

10. The vane assembly of claim 1, wherein said outer band defines an outer flowpath wall and wherein said inner band defines an inner flowpath wall.

11. The vane assembly of claim 1, wherein said friction damper portion and said air seal portion are formed from sheet metal.

12. The vane assembly of claim 1, wherein said damper seal is at least one of bolted and pinned to said inner band.

13. A damper seal for a vane assembly of a gas turbine engine, comprising:

a friction damper portion having a surface structured to contact a plurality of segments of said vane assembly to provide friction damping of said plurality of segments; and an air seal portion having a compressible end face seal structured to extend axially outward of and axially away from said plurality of segments toward a gas turbine engine component that is spaced apart from said plurality of segments in an axial direction, wherein said compressible end face seal is structured to seal against an axial face of the gas turbine engine component, wherein said air seal portion is integral with said friction damper portion.

14. The damper seal of claim 13, wherein said friction damper portion and said air seal portion are formed as a continuous ring.

15. The damper seal of claim 13, wherein said damper seal is formed from sheet metal.

16. The damper seal of claim 15, wherein said air seal portion is compressible in the axial direction.

17. The damper seal of claim 13, wherein said air seal portion is structured as a bellows.

18. The damper seal of claim 17, wherein said air seal portion includes at least two convolutions extending in the axial direction.

19. The damper seal of claim 13, wherein said surface extends in the axial direction.

20. A gas turbine engine, comprising:

a vane assembly having a plurality of segments; and a damper seal for said vane assembly, wherein said damper seal includes:

means for providing friction damping of at least some of said plurality of segments of said vane assembly; and means for sealing against a face of a gas turbine engine component that is spaced apart from said plurality of segments in an axial direction, wherein said means for sealing is integral with said means for providing friction damping; and wherein said means for sealing is axially compressible and extends axially outward of and away from said plurality of vane segments and toward the gas turbine engine component.

* * * * *